United States Patent [19]

Osterhout et al.

[11] Patent Number: 4,523,379

[45] Date of Patent: Jun. 18, 1985

[54] KNIFE WITH RETRACTABLE SHEATH

[75] Inventors: Ralph F. Osterhout, San Francisco; John D. Burr, Redwood City; Eric R. Larson, San Francisco, all of Calif.

[73] Assignee: Tekna, Belmont, Calif.

[21] Appl. No.: 606,317

[22] Filed: May 2, 1984

[51] Int. Cl.[3] ..... B26B 29/02

[52] U.S. Cl. ..... 30/151; 30/162; 30/286; 30/295

[58] Field of Search ..... 30/162, 151, 286, 295, 30/320, 294; 7/165, 167; 145/64

[56] References Cited

U.S. PATENT DOCUMENTS

| | | | |
|---|---|---|---|
| 1,679,666 | 8/1928 | Kass | 30/162 |
| 1,701,771 | 2/1929 | Di Stefano | 30/162 |
| 1,896,580 | 2/1933 | Gilmere | 30/151 X |
| 2,512,237 | 6/1950 | Mravik | 30/151 |
| 2,644,230 | 7/1953 | Anderson | 30/151 |
| 3,943,627 | 3/1976 | Stanley | 30/151 |
| 4,086,698 | 5/1978 | Sparks | 30/286 X |
| 4,091,537 | 5/1978 | Stevenson, Jr. | 30/286 |
| 4,393,587 | 7/1983 | Kloosterman | 30/162 |

FOREIGN PATENT DOCUMENTS

| | | | |
|---|---|---|---|
| 340976 | 9/1920 | Fed. Rep. of Germany | 30/295 |

*Primary Examiner*—Jimmy C. Peters

*Attorney, Agent, or Firm*—Townsend & Townsend

[57] ABSTRACT

A safety utility knife includes a handle, a blade fixed to the forward end of the handle, and a retractable sheath which is received within the handle. A mechanism is provided for automatically retracting the sheath within the handle by depressing a single button at the rear of the handle.

19 Claims, 6 Drawing Figures

KNIFE WITH RETRACTABLE SHEATH

BACKGROUND OF THE INVENTION

1. Field Of The Invention

The present invention relates generally to the construction of knives and other sharpened implements, and more particularly to the construction of an integral cover to protect such an implement from damage and from damaging its surroundings.

2. Description Of The Prior Art

Knives and other cutting implements are necessarily sharpened in order to be useful. While being essential for their utility, the sharpened edge of a knife can present a danger to people and property when it is being stored or transported. This is particularly true of small utility knives which are frequently carried in pockets and purses where they expose the carrier to severe injury. Moreover, the knife blade itself can be dulled or damaged by storage in an unprotected manner under such conditions.

Recognizing these problems, a number of techniques have been developed for protecting knife blades when not in use. Perhaps the most simple method is the use of a separate blade sheath for covering the blade. The knife may be simply withdrawn from the sheath for use and returned to the sheath when not in use. The use of a sheath, although suitable for many applications, suffers from certain drawbacks. First, sheaths are easily misplaced and separated from the companion knife during use. A lost sheath provides no protection whatsoever. Second, the removal of the sheath requires two hands, while the user often only has one hand available to manipulate the knife.

To overcome these problems, other approaches have been developed for protecting knife blades. The most common is probably the pocketknife having a folding blade. Such knives include a handle having one or more articulated blades attached to the end(s). The blades may be unfolded and exposed for use, and folded back into the handle for storage. Such knives, although they enjoy wide popularity, are not suitable for all purposes. Many times it is desirable to use a fixed-blade knife where the blade is firmly attached to the handle. The articulated blades of pocketknives are subject to collapse during use and can cause severe injury to the user. Moreover, folding pocketknives are even more difficult to uncover and manipulate with one hand than fixed knives having separate sheaths.

Another type of knife which is a variation on the folding pocketknife is the spring-loaded pocketknife, or "switchblade" where the blade can be extended simply by pushing a button. The only advantage of such knives is that they can be opened using only one hand. Conversely, the knives suffer from a number of disadvantages. The knife blade opens very quickly, and accidental actuation can be very dangerous. Moreover, the extended knife blades are subject to accidental collapse which can injure the user in the manner just described for folding pocketknives. Thus, the spring-loaded pocket knife is not suitable for routine use.

Other safety knives and implements have been described in the patent literature. U.S. Pat. No. 4,091,537 to Stevenson, Jr. describes a safety utility knife having a spring-loaded blade guard. U.S. Pat. No. 2,644,230 to Anderson describes a carton cutter having a retractable blade guard. U.S. Pat. No. 2,512,237 to Mravik discloses a nail file having a retractable sheath which can be manually retracted into a handle and automatically extended from the handle.

SUMMARY OF THE INVENTION

The present invention provides an implement comprising a hollow handle having a tool typically a knife blade, attached at one end. A protective sheath is mounted around the tool and can be retracted into the handle when it is desired to expose the tool. Conveniently, the tool is mounted in an open end of the handle on one or more posts which extend across the opening. The sheath is provided with a pair of slots in opposed walls thereof, which slots are received on the posts and allow the sheath to slide between a fully extended and fully retracted position. Normally, the knife will be stored with the sheath in its fully extended, protective position, and a mechanism is provided for automatically retracting the sheath to expose the tool. Typically, the mechanism utilizes an elastic member which is compressed as the sheath is manually extended to cover the blade and a latching mechanism which holds the sheath in this extended position. By releasing the latching mechanism, the blade or tool can be exposed for use.

The present invention is particularly suitable for constructing an improved safety utility knife including a number of desirable features not found in the prior art. The knife is highly compact and includes maximum blade length relative to the length of the handle. The prior art devices including retractable sheaths and blade guards have included only very small blades relative to the handle size because of the bulky mechanism required to retract or extend the sheath from the handle. The knife of the present invention also includes a particularly reliable sheath release mechanism that is easy to actuate, yet resists accidental actuation.

DESCRIPTION OF THE PREFERRED EMBODIMENT

Figure 1:
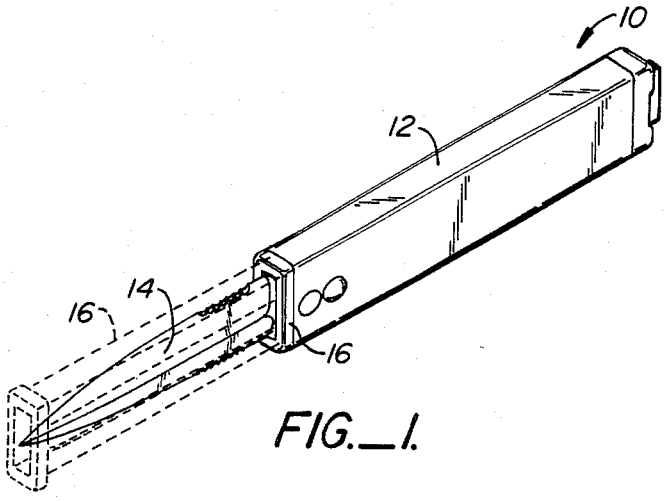
FIG. 1 is an isometric view of a knife constructed in accordance with the present invention illustrating a fully extended sheath in broken lines.

An implement constructed in accordance with the principles of the present invention is illustrated in FIGS. 1–4. Referring in particular to FIG. 1, the implement 10 is a safety knife comprising a handle 12, a knife blade 14 mounted at the forward (to the left in FIG. 1) end of the handle 12, and a protective sheath 16 which is retracted into the handle 12 in order to expose the knife blade 14. The sheath 16 is shown in its retracted position in full line while it is shown in its fully extended position in broken line. In addition to the handle 12, tool 14, and sheath 16, the implement 10 will include a mechanism for automatically retracting the sheath from the fully extended to fully retracted position, as will be described in detail below.

Although the implement 10 is illustrated as a knife, it is to be understood that the implement can include any type of tool where it is desired to provide an integral protective cover or sheath. In addition to knife blades, such tools include awls, files, picks, punches, and the like.

Figure 2:
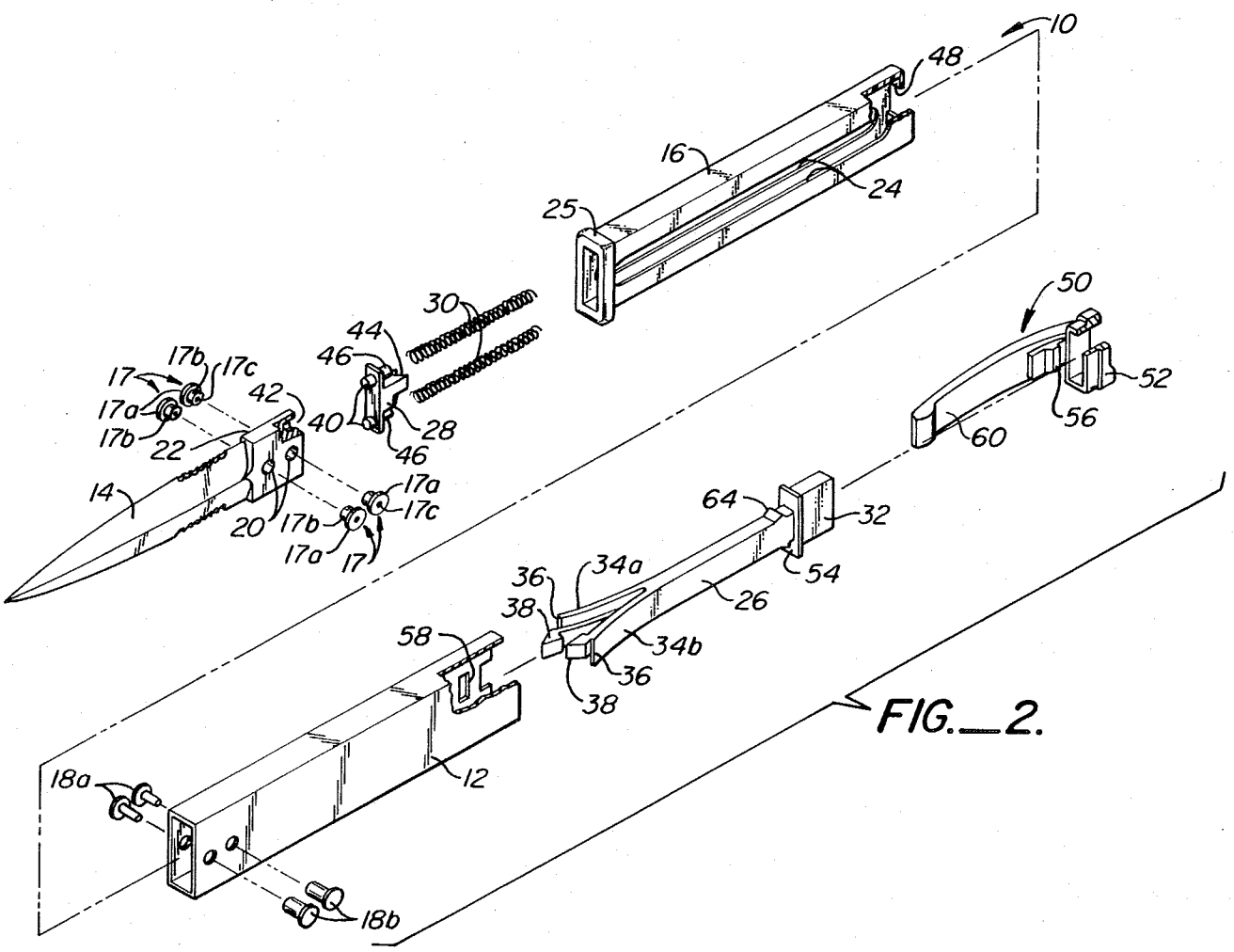
FIG. 2 is an exploded view showing all components of the preferred embodiment of the knife.

Referring now to FIG. 2, the construction of the knife 10 will be described in detail. The handle 12 is a hollow, elongate member which is open at each end. Conveniently, the handle 12 will have a rectangular cross-section which is slightly larger than the periphery of the sheath 16. In this way, the sheath 16 is free to slide in and out of the handle, as will be described in detail below.

The knife blade 14 is mounted at the forward end of the handle 12 on a pair of stepped bushings 17, each of which includes a flanged portion 17*a*, a cylindrical projection 17*b*, and an axial hole 17*c*. In the final assembly, the projection 17*b* is pressed into a hole 20 in a shank 22 formed at the rear (to the left in FIGS. 1 and 2) end of knife blade 14. Rivets 18 are used to secure the shank 22 to the handle 12. Male rivets 18*a* and female rivets 18*b* are joined together in holes 17*c*, as illustrated. The shank 22 also has a rectangular cross-section, but the cross-sectional dimensions are less than the interior dimensions of the handle 12. Thus, the shank 22 is spaced apart from the interior walls of the handle 12 when the knife blade 14 is mounted therein. This space allows the protective sheath 16 to freely reciprocate in and out of the handle 12, and allows blade attachment at the forward end of the handle. By firmly attaching the shank of the blade 14 to the forward end of the handle 12, a particularly sturdy blade attachment is provided.

The sheath 16 also has a rectangular cross-section and is opened at each end. Slots 24 are provided in opposite walls of the sheath. The slots 24 are received on the cylindrical projections 17*b* of bushings 17 when the knife is assembled, allowing the sheath 16 to slide along said bushings between its fully extended and fully retracted positions. Conveniently, the sheath 16 will be fabricated from a lubricous plastic to allow the sheath to slide freely in the handle 12. A forward flange 25 is provided on the sheath 16, and travel of the sheath into the handle 12 is limited by the sheath while extension from the handle is limited by the slot 24.

As described thus far, the knife 10 includes the handle 12, the knife blade 14 mounted at the forward end of the handle 12, and a sheath 16 which can be extended from the handle to cover the knife blade or retracted within the handle to expose the knife blade. The knife 10 also includes a mechanism for latching the sheath in its fully extended position to cover the blade 14 and for automatically retracting the sheath to expose the blade for use.

The latching and retracting mechanism comprises a latching member 26, a release member 28, and a pair of compressible coil springs 30. The latching member 26 is an elongate bar, typically made from plastic or another resilient material, having an actuating button 32 at one end and being forked at the other end. The forked end includes a first tine 34*a* and second tine 34*b*, each tine including a retaining shoulder 36 and terminating in an inclined surface or wedge 38.

The release member 28 includes a pair of mounting studs 40 which are received in corresponding holes 42 in shank 22 of the knife blade 14. Thus, the release member is attached to the handle solely through the knife 14 and pins 18, and the sheath 16 is free to slide by the release member 28. The release member 28 also includes a pair of inclined surfaces or wedges 44 (best illustrated in FIGS. 3 and 4) which mate with the wedges 38 on the latching member 32, as will be described below.

Each coil spring 30 is mounted on a mounting stud 46 on the release member 28. Thus, the coil springs 30 are also fixedly attached to the handle through the knife 14 and posts 18. The sheath 16 can be moved past the springs 30, but as the sheath is extended out of the handle 12, a flange 48 formed at the rear of the sheath 16 engages and compresses each spring 30 (see FIG. 3A).

A clip member 50 is provided to complete the construction of the knife 10. The clip 50 includes a cap 52 which is received in the rear open end of the handle 12. The cap 52 is open to receive the button 32 of latching member 26. The latching member is prevented from falling out of the handle, however, by a flange member 54 which is held by the cap 52 when the knife is assembled. The cap 52, in turn, is held in place by a stud 56 which is received in hole 58 in the handle 12. The cap 52 includes a clip 60 which allows the knife to be conveniently carried in the user's pocket.

Figure 3A:
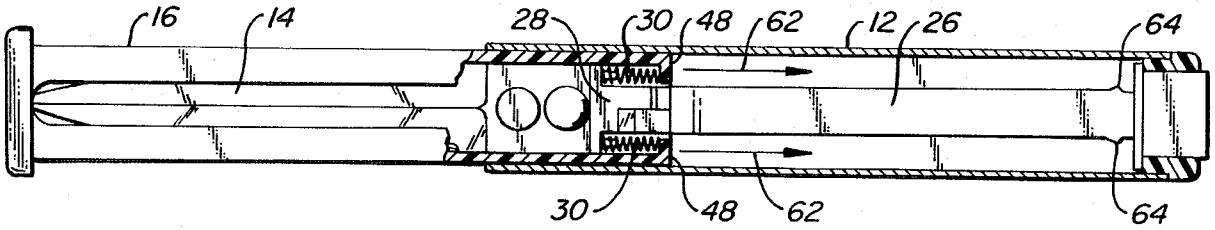
FIGS. 3A and 3B are side elevational views of the knife with portions broken away, illustrating the sheath in its extended and retracted positions, respectively.

Now that the construction of the knife has been described, its operation will be described with reference to FIGS. 3 and 4. FIG. 3A illustrates the knife having the protective sheath 16 in its fully extended position. The coil springs 30 are fully compressed by flanges 48 at the rear of the sheath 16, and the sheath is retained in its extended position by shoulders 36 of the latching member 26, as will be described and referenced to FIGS. 4A and 4B.

Figure 3B:
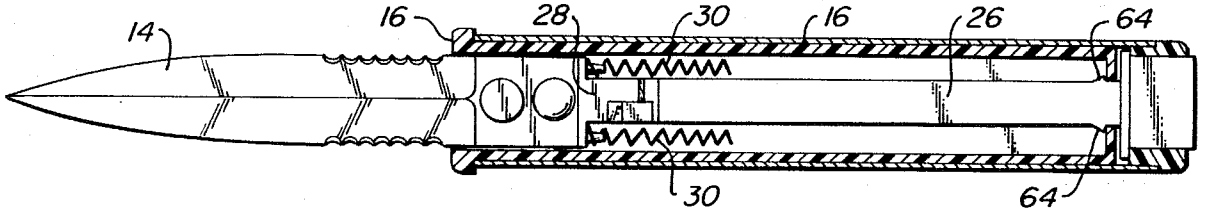

As the sheath 16 is released from the latching member 26, the coil springs 30 impel the sheath into the handle 12 in the direction of arrows 62. The sheath 16 continues its motion until it is fully retracted within the handle 12, as illustrated in FIG. 3B.

It should be noted that the springs 30 do not extend the full distance of the sheath 16 when it is in its retracted position. By utilizing shorter springs 30, the length of the sheath 16 extending to the rear of the blade when the sheath is fully extended can be reduced. This allows the length of the handle 12 to be reduced relative to the length of the knife blade 14. One problem with the prior art devices has been that the mechanism required to actuate the protective cover has been so bulky that the handle length had to be much greater than the length of the blade or other tool. This is avoided in the construction of the present invention in part by the utilization of shortened springs 30.

The sheath 16 is retained in its fully retracted position on detents 64 on latching member 26.

Figure 4A:
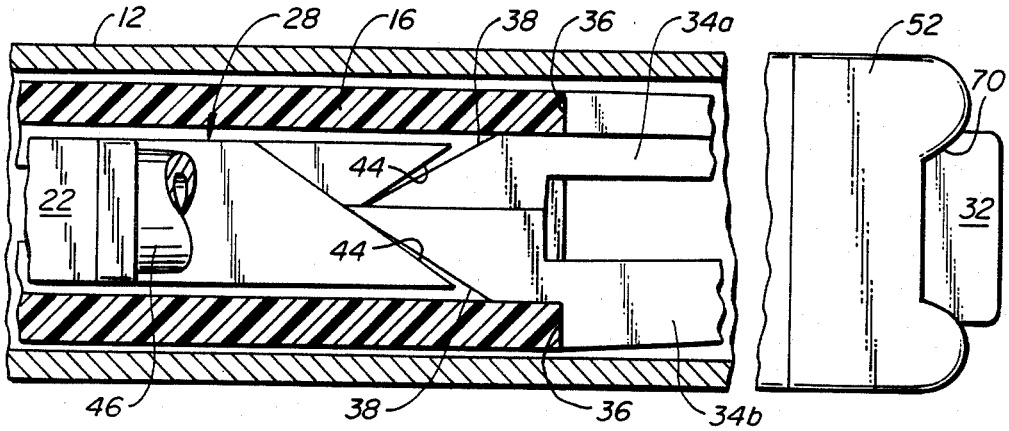
FIGS. 4A and 4B are detailed views illustrating the operation of the latching mechanism.
Figure 4B:
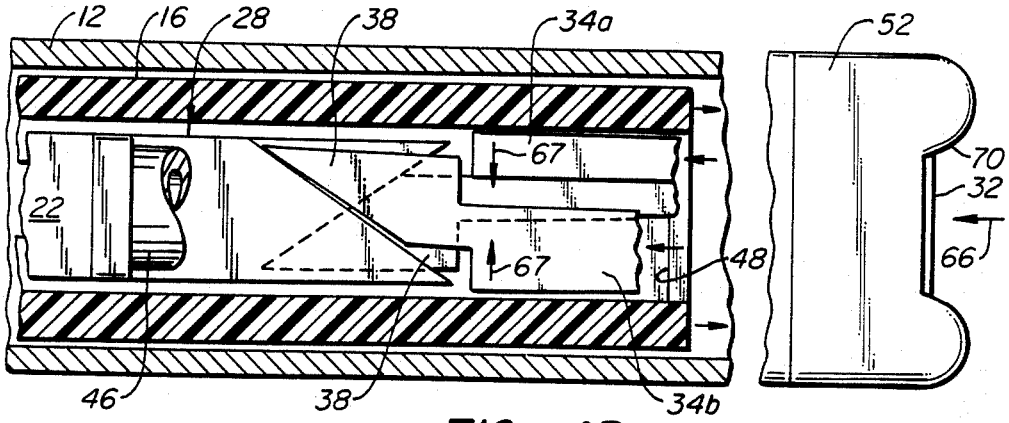

Turning now to FIGS. 4A and 4B, the operation of the latching mechanism will be described in detail. In FIG. 4A, the sheath 16 is in its extended position with the rear of the sheath being retained on shoulders 36 of the tines 34. The tines 34 project into the open rear end of sheath 16 and are held in that position by the force of springs 30. The inclined surfaces of each wedge 38 mate with the corresponding inclined surface on the release member 28.

Referring now to FIG. 4B, the tines 34 may be urged forward by depressing button 32 on latching member 26 in the direction of arrow 66. As the tines 34 move forward, the interaction of the wedges 38 with the corresponding inclined surfaces 44 on the release member 28 causes the tines 34 to compress in the direction of arrows 67. As the tines 34 compress, the sheath 16 is released from the retaining shoulders 36 and is impelled into the handle by the coil springs 30, as described above. The sheath 16 then assumes its fully retracted position, as illustrated in full line in FIG. 1.

To restore the protective sheath to its extended position, the user manually draws the sheath from the handle 12. When the sheath is drawn sufficiently far forward, the rear of the sheath passes the retaining shoulders 36 on the tines 34, and the tines are free to spring back to their open position where they prevent the sheath from moving back into the handle 12. The sheath 16 may not be drawn too far from the handle 12, as over travel is prevented by properly sizing the slots 24.

The button 32 is received in a recess 70 in the cap 52. In order to release the sheath into the handle, the button 32 must be depressed fully within the recess 70, as illustrated in FIG. 4B. Thus, the recess acts as a safety feature to prevent accidental release of the sheath 16. Accidental pushing of the button against a flat surface will not be able to fully depress the button 32. Only by intentionally depressing the button will the user release the sheath 16.

Although the foregoing invention has been described in some detail by way of illustration and example, it will be understood that the present invention is not limited to the particular description and instead is defined by the following claims.

What is claimed is:

1. An implement comprising:

a handle having a hollow interior with an opening at one end;

a tool fixedly attached to the handle at the opening;

a sheath slidably mounted within the hollow interior of the handle to reciprocate between an extended position where said sheath covers the tool and a retracted position where the tool is exposed;

a compressible elastic member disposed between the sheath and the tool so that said elastic member is relaxed when the sheath is fully retracted and compressed when the sheath is extended; and means for releasably securing the sheath in its fully extended position, whereby when the sheath is released, the elastic member will extend and impel the sheath into the interior of the handle.

2. An implement as in claim 1, wherein the means for releasably securing the sheath comprises:

an elongate latching member slidably mounted within the handle and having a fork at the end proximate the tool, said fork including a pair of tines capable of engaging the sheath when it is in its fully extended position and preventing the sheath from being retracted by the elastic member; and means mounted within the handle cavity for collapsing the tines inward to release the sheath when the latching member is urged toward the tool.

3. An implement as in claim 2, wherein the latching member includes a button at the end remote from the tool, said button extending out of the handle so that a user can depress the button to urge the latching member toward the tool and release the sheath.

4. An implement as in claim 3, wherein the button is recessed in the handle.

5. An implement as in claim 2, wherein each tine on the fork terminates in an inclined surface, and wherein the means for collapsing the fork tines inward comprises a pair of inclined surfaces fixedly mounted in the handle, said inclined surfaces on the collapsing means mating with the inclined surfaces on the tines so that the tines are forced inward as the latching member is urged toward the collapsing means.

6. An implement as in claim 2, further comprising means for retaining the sheath in its retracted position.

7. An implement as in claim 6, wherein the retaining means comprises detents on the latching member.

8. An implement as in claim 1, wherein the compressible elastic member is a coil spring.

9. An implement as in claim 8, wherein the coil spring is secured at one end relative to the tool and is free at its other end to engage the sheath as it is extended, said spring not extending a sufficient distance to engage the sheath when the sheath is fully retracted.

10. A safety knife comprising:

an elongate handle having a hollow interior with openings at each end;

a knife blade fixedly secured in one opening of the handle by at least one post, the periphery of the blade being spaced apart from the interior wall of the opening;

a protective sheath having four side walls and being open at either end, said sheath having slots in a pair of opposite side walls, which slots are received on the post to allow the sheath to slide between an extended position where the knife blade is fully covered and a retracted position where the sheath is fully received within the handle; and means for retracting the sheath from its fully extended position to its fully retracted position.

11. A safety knife as in claim 10, wherein the means for retracting the sheath comprises:

a compressible elastic member mounted inside the handle so that said member is compressed as the sheath is extended; and means for releasably securing the sheath in its fully extended position, whereby when the sheath is released, the elastic member will extend and impel the sheath into its retracted position.

12. A safety knife as in claim 11, wherein the means for releasably securing the sheath comprises:

an elongate latching member slidably mounted within the sheath and having a fork at one end proximate the knife blade, said fork including a pair of tines capable of engaging the sheath when it is in its fully extended position and holding the sheath against the force of the compressed elastic member; and means mounted in the handle for collapsing the tines inward to release the sheath as the latching member is urged toward the blade.

13. A safety knife as in claim 12, wherein the latching member includes a button at the end remote from the knife blade, said button extending out of the handle so that a user can depress the button to urge the latching member toward the knife blade and release the sheath.

14. A safety knife as in claim 13, wherein the button is recessed in the handle.

15. A safety knife as in claim 12, wherein each tine on the fork terminates in an inclined surface, and wherein the means for collapsing the fork tines inward comprises a pair of inclined surfaces fixedly mounted in the handle, said inclined surfaces on the collapsing means mating with the inclined surfaces on the tines so that the tines are forced inward as the latching member is urged toward the collapsing means.

16. A safety knife as in claim 10, further comprising means for retaining the sheath in its retracted position.

17. A safety knife as in claim 16, wherein the retaining means comprises detents or latching member.

18. A safety knife as in claim 11, wherein the compressible elastic member is a coil spring.

19. A safety knife as in claim 18, wherein the coil spring is secured at one end relative to the tool and is free at its other end to engage the sheath as it is extended, said spring not extending a sufficient distance to engage the sheath when the sheath is fully retracted.

* * * * *